United States Patent [19]

Bouchard

[11] Patent Number: 5,004,001

[45] Date of Patent: Apr. 2, 1991

[54] FOLDABLE DOME

[76] Inventor: Victorin Bouchard, 671 Rang 6, St Nazaire de Chicoutimi, Quebec, Canada, G0W 2V0

[21] Appl. No.: 390,867

[22] Filed: Aug. 8, 1989

[51] Int. Cl.[5] ..... E04H 15/18

[52] U.S. Cl. ..... 135/97; 135/103; 135/102

[58] Field of Search ..... 135/102, 97, 103, 104, 135/900–902, 109, 113; 52/63, 64, 66

[56] References Cited

U.S. PATENT DOCUMENTS

| | | | |
|---|---|---|---|
| 2,036,033 | 3/1936 | Fisher | 135/102 |
| 2,829,659 | 4/1958 | Megenity | 135/109 X |
| 2,877,722 | 3/1959 | Peat | 135/102 X |
| 3,563,257 | 2/1971 | Cummins | 135/102 |
| 3,865,123 | 2/1975 | Bracken . | |
| 4,120,067 | 10/1978 | Hone et al. | 135/103 X |
| 4,163,295 | 8/1979 | Schutz | 135/109 X |
| 4,440,187 | 8/1984 | Fiddler . | |

FOREIGN PATENT DOCUMENTS

| | | | |
|---|---|---|---|
| 574681 | 4/1959 | Canada . | |
| 706186 | 3/1965 | Canada . | |
| 1009536 | 5/1977 | Canada . | |
| 1047873 | 2/1979 | Canada . | |
| 1096743 | 3/1981 | Canada . | |
| 79156 | 9/1955 | Netherlands | 135/109 |

*Primary Examiner*—David A. Scherbel
*Assistant Examiner*—Lan Mai
*Attorney, Agent, or Firm*—Edwin E. Greigg

[57] ABSTRACT

A foldable dome which comprises a set of bowed supports made up of a driving bowed support, an end bowed support and intermediate bowed supports, said bowed supports ending into levers projecting out of the planes thereof. These bows are supported, on each side of the dome, on bowed supports provided at the top with the pivot mechanism each of which comprises an axle, transverse said bowed supports, over which said levers on one side of said bowed supports are mounted so as to allow rocking of said bowed supports between a folded position, on one side of said axle, and an unfoldable position wherein said bowed supports are supported around said axle in the form of a dome. The axle dividing said levers of said divides and end bowed supports each into a driven section, on the bowed support side and a driving section on the side away from the bowed supports. The pivot mechanism further comprises an axially extensible device of which one end is pivotably mounted at the top of said post and a linkage mechanism pivotally connecting the other end of the device simultaneously to the lever driving section of the driving bowed supports and to the lever driving section of the end bowed support, on opposite sides of the device. Finally, a sheltering fabric is connected successively to the bows so that extension and shortening of the device causes, through the linkage mechanism, rocking of the bows between the aforesaid processions with driving of the fabric and when the end bows is held stationary.

15 Claims, 3 Drawing Sheets

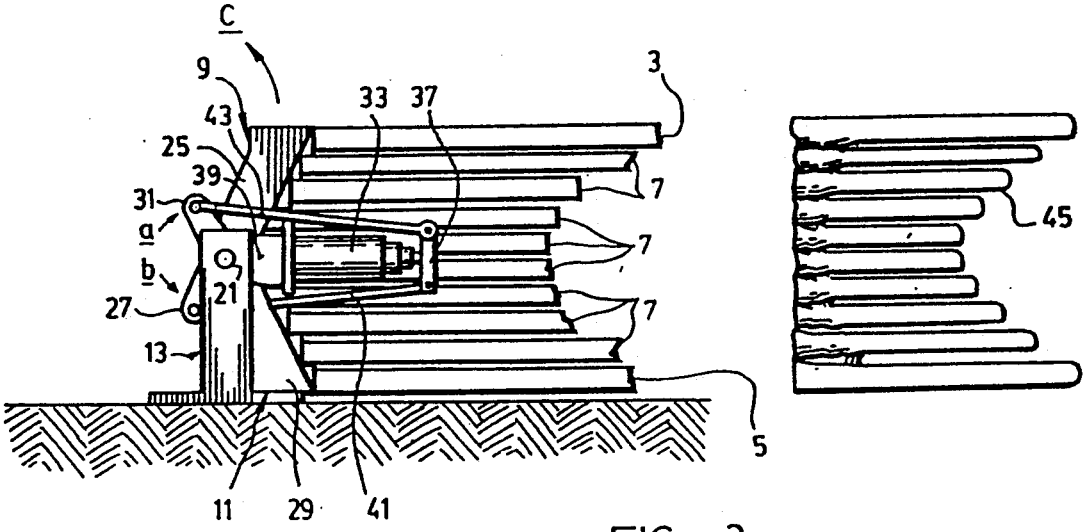
FIG. 2
FIG. 3
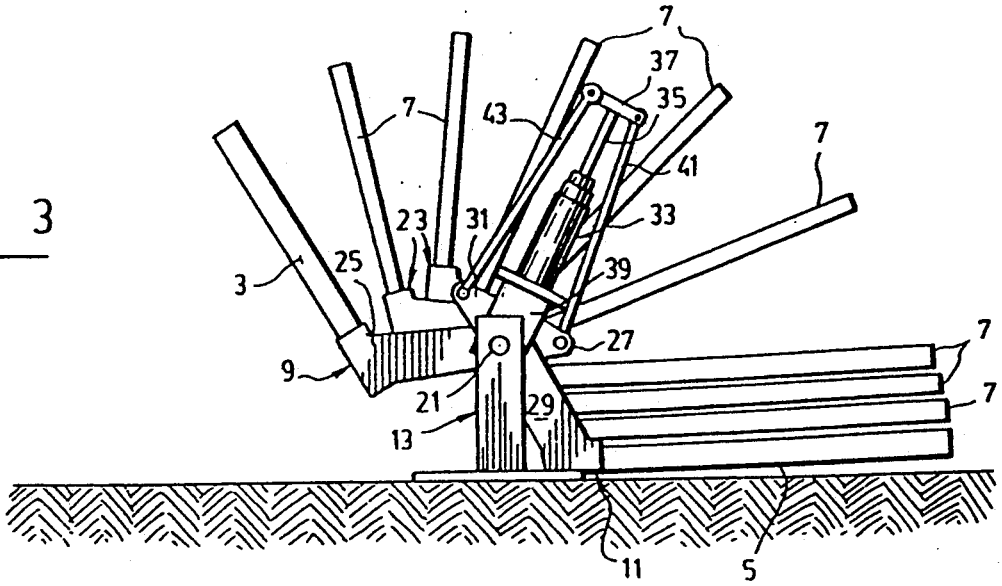

FOLDABLE DOME

BACKGROUND OF THE INVENTION

1. Field of the Invention

The present invention relates to an improved shelter in the form of a dome particularly but not exclusively intended to cover a circular area or pool which in the shelter can be easily folded on one side of the pool and unfolded above it when has a shelter is necessary.

2. Description of the Prior Art

The present inventor has made a search prior to the filing of the present application, which has revealed the following patents:

Canadian patent Nos.:

574,681 of Apr. 28, 1959
1,009,536 of May 3, 1977
1,047,879 of Feb. 6, 1979
1,096,743 of Mar. 3, 1981

U.S. Pat. Nos.:

3,865,123 of Feb. 11, 1975
4,440,187 of Aug. 3, 1984

The only one of these patents which is of interest with respect to the present application is Canadian patent No. 1,047,879.

In this patent, the dome or shelter is made up of a set of bowed supports covered with the fabric or cloth stitched to the bowed supports. The ends of the latter are pivotably mounted onto triangular plates each one located on one side of the dome. The latter, in that position of the bowed supports and folded on the central bowed support has first to be moved vertically and the triangular plates secured to the ground. The dome is made in a position of use by unlocking the bowed supports and by letting them drop on either side of the central bow.

Folding up is obtained by means of physical strength actuated manually or by means of a gear mechanism.

The above system, which has nothing in common with that suggested by the present application, as the inconvenience that the folded dome must first be placed upright in order to be able to unfolded and, simultaneously, each bowed supports has to be unlocked when the system is manually operated. The mechanical system is more expansive and has the same inconvenience that the folded dome must first be moved upright in order that it may be unfolded.

SUMMARY OF THE INVENTION

The main object of the invention lies in providing a shelter in the form of a dome, preferably hemispherical with the circular base so that it may be placed around a circular swimming pool or around any other object to be protected, which dome may be easily folded into a laid-down position on one side of the pool so that it may not be too cumbersome.

Another object of the invention is to provide a dome of the above mentioned type, which may be unfolded as easily as it may be folded directly from the laid-down folded position up to a fully unfolded or semi-folded position.

A further object of the invention is to provide a dome of the above mentioned type, which is equipped, at its center, with a simple low cost mechanism with which the dome is folded and unfolded.

More specifically, the invention relates essentially to a folded dome which comprises a set of bowed supports made up of a driving bow, an end bowed support and intermediate bowed supports, such bows ending into levers projecting out of their planes as well as a pair of posts are supporting the bowed supports each bowed supports being located on diametrically opposite sides of the dome. At the top of each post are provided perfect means comprising an axle, transversed to the post, over which the levers on one side of the bowed supports are mounted so as to allow rocking over the bowed supports between a folded position, on one side of the axle, and unfolded position wherein the bows are disposed around the axle in the form of the dome; the axle further dividing the levers of the driving and end bowed supports each into a driven section, on the bowed support side and a driving section on the side away from the bowed supports. The pivot means additionally comprise, on each post, an axially extensible device of which one end is pivotably mounted at the top of the post and linkage means pivotably connecting the other end of the device simultaneously to the lever driving section of the driving bowed support and the lever driving section of the end bowed support, on opposite sides of the device. The dome finally includes a sheltering fabric which is connected successively to the bowed supports so that extension and the shortening of the devices cause, through the linkage means, rocking of the bowed supports between the positions with the driving of the fabric and when the end bowed support is held stationary.

The linkage means aforesaid preferably comprise two transmission arms of which the ends are pivotably connected directly to one end of the extensible device, on the one end, and respectively to the free ends of the driving sections over the driving bowed supports lever and the end bowed support lever, on the other end. To facilitate mounting of the linkage means, the latter may comprise a crossed bar followed with the device into the ends of which the transmission arms are pivotably connected.

A description of a preferred non limitative embodiment of the invention, with variants, will now be given, having reference to appended drawings.

BRIEF DESCRIPTION OF THE DRAWINGS

FIG. 2 is a side view elevation of the dome in folded position;

FIG. 3 is likewise a side elevational view illustrating the dome, without the covering canvas, during the unfolding operation;

DESCRIPTION OF A PREFERRED EMBODIMENT

Figure 1:
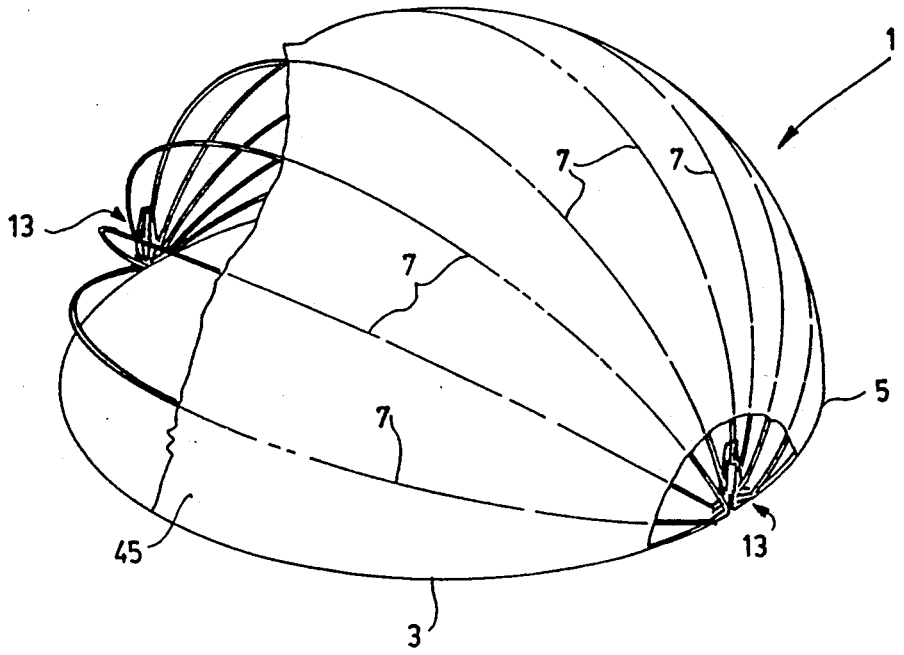
FIG. 1 is a diagrammatic perspective view of a foldable dome made according to the teaching of the invention.

Referring to the drawings, the dome 1 made according to the invention is a hemispherical shelter with a circular base and provided with a set of bowed support including a driving bowed support 3, and end bowed support 5 and intermediate bows 7. All of these bowed supports are integrally formed at their ends with levers that project out of their plane; comprising the levers 9 of the driving bowed support 3 and the levers 11 of the end bowed support 5.

The bowed support are supported, through their levers, onto bowed support posts 13 located diammetrically on either side of the dome. As better seen in FIG. 4, each of these posts is made up of two vertically spaced parallel arms 15 extending from a base plate 17 secured to the ground by anchoring bolts 19.

Pivot means are provided, at the top of each post, to allow rocking of a the bowed supports between a folded position (FIG. 2) where they pile up on one side of the dome, and unfolded position (FIG. 1), where they are spread out of the form of the dome.

The pivot means comprise, on each one of these arms 15, a transverse axle 21 over which the levers 9, 11, and the levers of the intermediate bowed supports, here generically numbered 23 (FIGS. 3 and 4), pivotably mounted to allow the aforesaid rocking motion. In FIGS. 2 and 3, it will be noted that the axle 21 divides the driving lever 9 and the terminal lever 11 into a driving section 25 and a driving section 27, for the lever 9, and a driven section 29 and a driving section 31, for the lever 11; the driven sections 25 and 29 being located on the side near the corresponding bowed support whereas the driving sections 21 and 31 are located on the side way for it. The pivot means likewise comprise an axial extensible device on opposite sides of the tent which may be a hydraulic, pneumatic or manual jack, each having a rod 35 movable in transmission and of which the free end is preferably in the former T having a cross bar 37. At the opposite end, the jack 33 is formed with two plates 39 pivotably mounted on the axle 21. Finally, the pivot means additionally includes a linkage mechanism pivotally connecting the free end of the rod 35 simultaneously with the driving section 27 of the lever 9 and with the driving section 31 of the lever 11; sections 27 and 31 being located on diammetrically opposite sides of the jack 33.

In the illustrated embodiment, this linkage mechanism comprises a cross arm 37 and two transmission arms 41, 43, of which the ends are connected, through pivots, to the ends of the cross bar, on one end, and respectively to the free ends of the driving sections 27, 31 on the other end. It would however be understood that the cross bar 37 is provided only for a question of structural convenience; the upper ends of the arms 41, 43, being likewise capable of being mounted, through a single pivot, to the end of the jack rod 35.

Referring now to FIG. 2, when the jack 33 on each side of the dome are pressurized and the rods 35 move up of their cylinders, the driving sections 27 and 31 of the levers 9 and 11 are reversed in direction as indicated by the arrows a and b. However, the two levers 29 of the end lever 5 being against the ground (or against the base plates 17 of the posts 13), they are unable to move and only the levers 9 of the driving bowed support 5 rock and indicate likewise direction, as indicated by the arrow c (FIG. 2) and allow the unfolding motion illustrated in FIG. 3. Withdrawal of the rod 35 within the cylinder forces reverse motion, that is folding up of the bowed supports.

A shelter cloth or fabric is obviously provided, in which the successive bows 3, 5, 7, in such a manner can be made of one piece but preferably consists of a plurality of sections 45 each mounted between two adjacent bowed supports such that extension and shortening of the jack 33, through the linkage means 37, 41, 43, causes pivoting of the bowed supports and a corresponding movement of the fabric between the explained positions shown in FIGS. 1 and 2.

Figure 5:
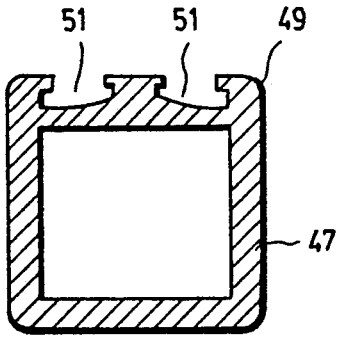
Figure 6:
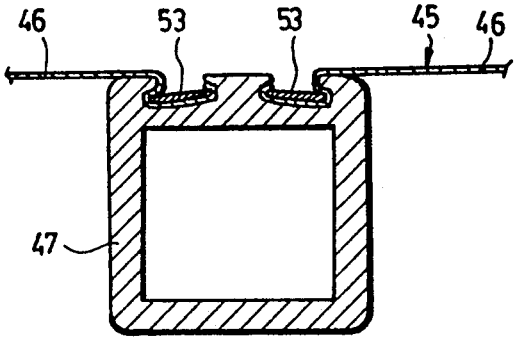

For doing so, and as shown in FIGS. 5 and 6, the bowed supports 3, 5, 7, may be in the form of hollow tubes 47 having essentially a flat outerface 49. The latter is formed with two parallel and continuous cavities 51 having an inverted T shape defining lateral grooves within which longitudinal edges of two adjacent sections 46 of the cloth 45 are respectively housed and retained by means of elongated plates 53 of which the sides are inserted in the grooves.

As shown in FIGS. 2 and 3, the bowed supports 3, 5, 7, are straightened up after their ends before being particularly joined with the levers 9, 11, 23, and the sheltering fabric 45 terminates at the upper ends of the straightened portion of the bowed supports, that is short of each post 13.

According to a variant, the levers 9 and 23 pivot on the axle 21 which is stationary by being made solid with the two posts 13. Sine the end post 5 must be stationary, its levers 29 may then be mounted in one way of the other on this stationary axle 21. According to this arrangement, the mounting plate 39 of the jack 33 obviously pivotes on the stationary axle 21.

Figure 4:
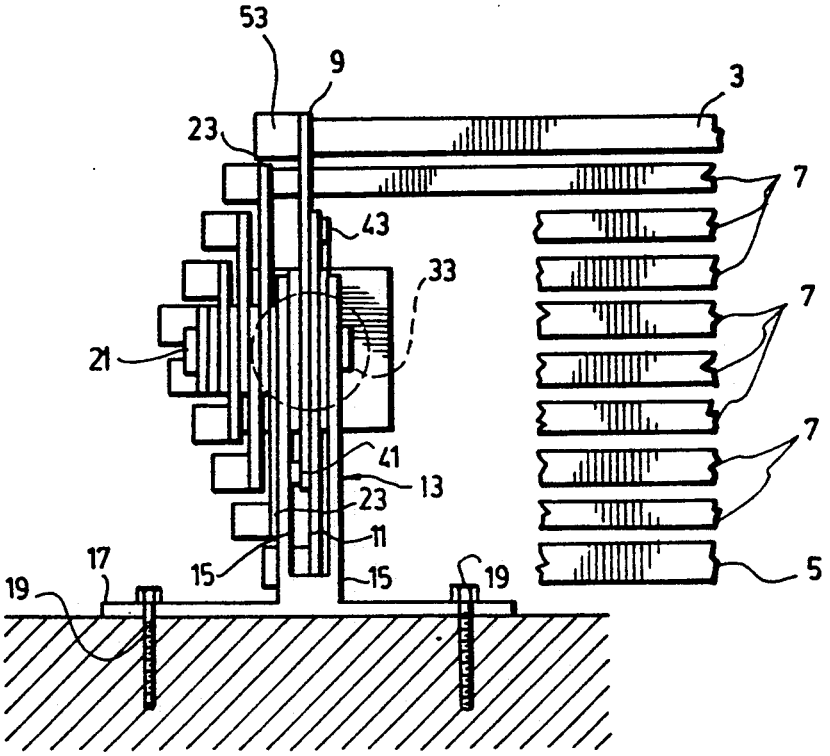
FIG. 4 is a diagrammatic end view taken from the left side of FIG. 2, and FIGS. 5 and 6 are cross-sectional views of a bowed support respectively without and provided with a sheltering fabric.

If reference is now made to FIG. 4, the particular arrangement of the bowed supports and their mounting on the axle 21 will be noted as well as the structure of the levers 9, 11 and 23. Each of the later is made up of a thin plate of which one end is mounted on the axle 21 and the other has the shape of a square block 53 projecting from one side of the plate and to which the straightened portion of the corresponding bow is secured. In order to obtain a compact pile of bowed supports the block 53 nest one into the other, as illustrated. A compact bowed support pile is also obtainable by mounting the levers 9, 11, 23, on the axle 21 alternatively upwardly and downwardly, as shown in FIG. 4. The driving lever 9 immediately follows the end lever 11 since the two levers must be located on each side of the jack 33.

While the bowed supports of the dome according to the above described preferred embodiment are essentially shaped as semi circles (see FIG. 1), it is obvious that their curvature may be different, more squared for instance, without affecting the invention in anyway.

Similarly, it is obvious that the jack may be operated to unfold the dome partially only and retain it in a semi-folded (or semi-unfolded) position whenever desired.

I claim:

1. A foldable dome comprising:

a set of bowed supports made up of a driving bowed support, and end bowed support and intermediate bowed supports, said bowed supports ending into levers projecting out of the planes thereof;

a post supporting said bowed supports on opposite sides of said dome and including, at the top thereof and on each post:

pivot means comprising an axle, transverse to said post, over which said levers on one side of said bowed supports are mounted so as to allow rocking of said bowed supports between a folded position, on one side of said axle, and an unfolded position wherein said bowed supports are disposed around said axle in the form of a dome; said axle dividing said levers of said driving and end bowed supports each into a driven section, on the bowed support side and a driving section on the side away from the bowed supports;

an axially extensible device of which one end is pivotably mounted at the top of said post;

linkage means pivotably connecting another end of said device simultaneously to said lever driving section of said driving bowed support and to said lever driving section of said end bowed support, on opposite sides of said device, and a sheltering fabric connected successively to adjacent bowed supports so that extension and shortening of said devices causes, through said linkage means, rocking of said bows between said positions with driving of said fabric and when said end bowed support is held stationary.

2. A dome as claimed in claim 1, wherein said linkage means comprise two transmission arms having ends pivotably connected directly to said one end of said extensible device, on the one hand, and respectively to the free ends of said driving sections of said driving bowed support lever and said end bowed support lever, on the other end.

3. A dome as claimed in claim 1, wherein said linkage means comprise; a cross bar with said extensible device and two transmission arms of which the ends are pivotably connected, on the one hand, to the ends of said cross-bar and, on the other hand, respectively to the free ends of said driving sections of said driving bowed support lever and said end bowed support lever.

4. A dome as claimed in claim 3, wherein said extensible device is a jack having a rod displaceable in translation and having a T-shaped free end comprising said cross-bar.

5. A dome as claimed in claim 4, wherein said bowed supports have an outer essentially flat face formed with at least one inverted T-shaped continuous cavity defining lateral recesses; said fabric is over said bowed supports and is lodged in said cavity and recesses and is retained therein by blades of which the sides are inserted in grooves.

6. A dome as claimed in claim 5, wherein said fabric on said bowed support terminates short of said bows.

7. A dome as claimed in claim 6, wherein said bowed supports and said pivot means are located at diametrically opposite sides of said dome.

8. A dome as claimed in claim 4, wherein one end of said jack is pivotably mounted on said transverse axle.

9. A dome as claimed in claim 1, wherein said axles between said posts are solid, at the ends thereof, with said posts; said levers of said driving and intermediate bowed supports pivoted on said axles and said levers of said end bowed support are solid with said axles and, consequently, are stationary with respect to said posts.

10. A dome as claimed in claim 9, wherein said linkage means comprise two transmission arms of which the ends are pivotably connected directly to said one end of said extensible device, on the one hand, and respectively to the free ends of said driving sections of said driving bowed support lever and said end bowed support lever, on the other end.

11. A dome as claimed in claim 9, wherein said linkage means comprise; a cross bar fixedly secured with said extensible device and two transmission arms of which the ends are pivotably connected, on the one hand, to the ends of said cross-bar and, on the other hand, respectively to the free ends of said driving sections of said driving bowed support lever and said end bowed support lever.

12. A dome as claimed in claim 11, wherein said extensible device is a jack having a rod displaceable in translation and having a T-shaped free end comprising said cross-bar.

13. A dome as claimed in claim 12, wherein said bowed supports have an outer essentially flat face formed with at least one inverted T-shaped continuous cavity defining lateral recesses; said fabric is over said bowed supports and is lodged in said cavity and recesses and is retained therein by blades of which the sides are inserted in grooves.

14. A dome as claimed in claim 1, wherein said bowed supports and said pivot means are located at diametrically opposite sides of said dome.

15. A dome as claimed in claim 1, wherein said one end of said extensible deice is pivotably mounted on said transverse axle.

* * * * *